United States Patent [19]

Gonzalez

[11] Patent Number: 5,025,707

[45] Date of Patent: Jun. 25, 1991

[54] HIGH PRESSURE GAS ACTUATED REACTIVE ARMOR

[75] Inventor: Rene Gonzalez, Southfield, Mich.

[73] Assignee: The United States of America as represented by the Secretary of the Army, Washington, D.C.

[21] Appl. No.: 495,554

[22] Filed: Mar. 19, 1990

[51] Int. Cl.[5] ..... F41H 5/007

[52] U.S. Cl. ..... 89/36.17; 109/29; 109/81

[58] Field of Search ..... 89/36.17; 109/20, 29, 109/58, 81

[56] References Cited

U.S. PATENT DOCUMENTS 3,427,139 2/1969 Gregory ..... 89/36.17

*Primary Examiner*—Stephen C. Bentley

*Attorney, Agent, or Firm*—Peter A. Taucher; Gail S. Soderling

[57] ABSTRACT

An improved reactive armor is disclosed. The armor has means which impinge on a penetrating threat to destroy its integrity and prevent incursion to the interior of an armored vehicle.

3 Claims, 1 Drawing Sheet

HIGH PRESSURE GAS ACTUATED REACTIVE ARMOR

GOVERNMENT INTEREST

The invention described herein may be manufactured, used, and licensed by or for the Government for governmental purposes without payment to me of any royalty thereon.

BACKGROUND OF THE INVENTION

1. Field of the Invention.

In one aspect this invention relates to armor useful for protecting combatants from hostile enemy fire. In a further aspect, this invention relates to armor which reacts to the incursion of a penetrator to thwart the penetrator's threat.

2. Prior Art.

There is an ongoing tension between the improvements in the lethality of the weapons and an ever increasingly sophisticated protective armor. Generally passive armor resists penetration of a projectile or the like by the material properties of the armor. When greater protection is necessary, the physical properties of the armor and/or its thickness are increased. Certain of todays modern weapons such as high energy kinetic rounds and shaped charge rounds can penetrate several feet of even the most sophisticated metallic passive armor. Therefore, it became necessary to provide armor which actively resists penetration by these sophisticated rounds. Such armors are generically called reactive armor. Reactive armor contains stored energy which is released against an incoming round which contacts the armor. Currently, the best known types of reactive armor store energy in the form of explosives. When the armor is hit, the explosives rapidly release energy to destroy or deflect the threat. These types of reactive armor provide improved protection. However use of explosives as an energy storage mean entails certain difficulties. One problem is the sensitive nature of any explosive material which can react rapidly enough to destroy or otherwise thwart the high speed penetrators used in todays moder weaponry. The sensitive nature of the explosives requires careful handling and installation with the chance for accidents ever present. Explosives also have the potential for chain initiation of explosions among the several plates of reactive armor mounted on the vehicle. For example, an impact element might detonate more than one reactive armor tile mounted on the vehicle thereby rendering the area protected by the tiles vulnerable over a substantial percentage of its exposed area. This increases the vehicles risk to successive rounds. Further, explosives require special care in handling, storage and shipping. While current explosive reactive armor has shown its ability to resist the incursion of penetrators under many circumstances it is desirable to develop less vulnerable and preferably more reliable types of armor.

SUMMARY OF THE INVENTION

An improved type of reactive armor structure adapted to reduce penetration of a projectile or chemical jet, collectively a penetrator, into the armor structure comprises generally a shaped piece of armor plate material placed on the outer surface of the vehicle or other area to be protected. The shaped piece of armor material encloses an interior cavity containing a plurality of penetrator resisting means. A source of high pressure compressed gas is contained within the armor structure and acts on the penetrator resistors so that the resistors are forced rapidly by the pressurized gas to the location of a lowered pressure in the armor structure. When a projectile or shaped charge intrudes into the interior of the armor structure, the resistors are projected so as to physically impinge on the penetrator or chemical jet as it enters the armored structure causing erosion and physical dislocation damage to the penetrator.

BRIEF DESCRIPTION OF THE DRAWING

In the accompanying drawing.

DETAILED DESCRIPTION OF PREFERRED EMBODIMENTS

Figure 1:
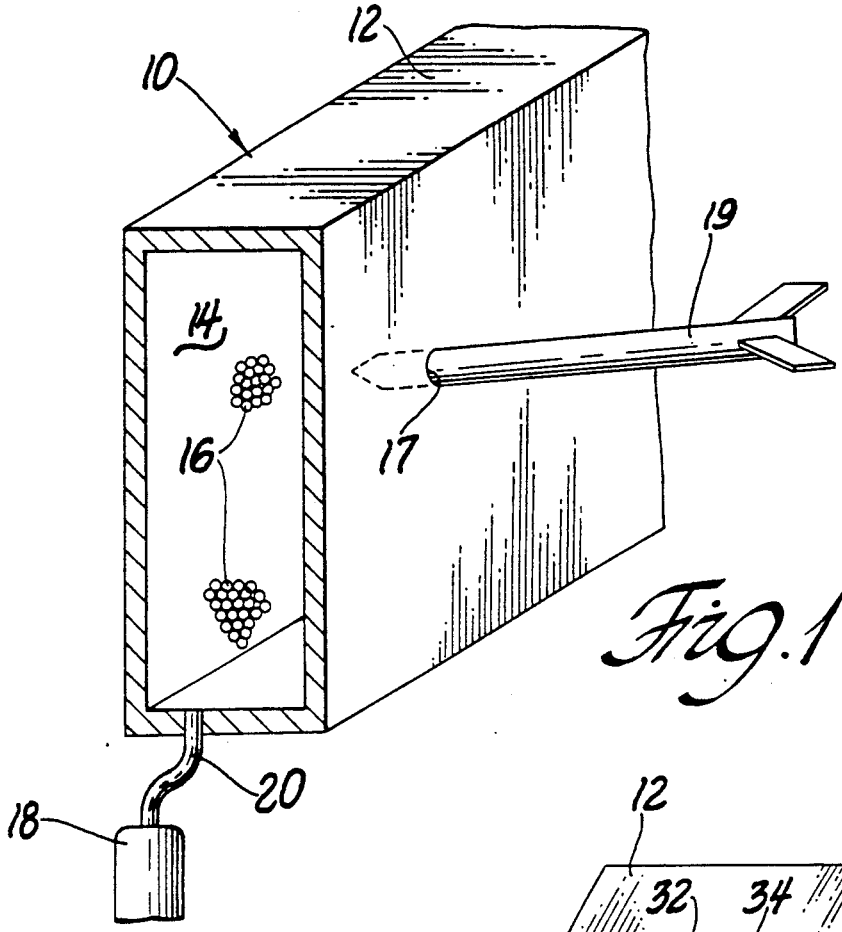
FIG. 1 shows an armor construction according to this invention with a penetrator entering the outer exposed portion of the armor.

Referring to the encompanying Drawing and initially to FIG. 1, an armor shell 10 is formed from armor plate material 12 such as by welding a plurality of plates to form a hollow cavity 14. The hollow cavity 14 contains a plurality of particles designated 16 which are of a size and configuration that they can be moved by a pressurized gas to the site 17 of an incursion by a penetrator shown here as a projectile 19 as it enters the surface of the armor shell 10. The incursion of projectile 19 creates a low pressure zone at incursion site 17. A source of pressurized gas 18 is shown connected to the hollow cavity 14 of the armor shell 10 by means of a channel 20. The pressurized gas provides sufficient pressure to initiate and maintain rapid movement of the particles 16 at penetration.

In operation, of the invention as shown in FIG. 1, the projectile 19 perforates the outer wall of the armor shell 10 creating a low pressure zone relative to the pressure maintained in cavity 14 at incursion site 17. The high pressure maintained within the cavity 14 will cause the particulate material 16 to move rapidly and forcefully towards the incursion site 17 eroding the penetrator 19 and disrupting its path.

The gas as used in this invention to provide the pressure would include any normally gaseous substance. The gas may be stored as a compressed gas maintained as shown in a container under high pressure. Examples of suitable gases include nitrogen, carbon dioxide, argon or other inert gas which remain gaseous at high pressures and ambient temperatures. The gas may be stored in a container 8 as shown or the gas may be pressurized in the the armor cavity 14 when the armor is placed on the vehicle. As an alternative, pressurized gas may be generated from a reactive combination of ingredients contained within the cavity and triggered by the projectiles incursion. Such gas generating compounds and mixtures are known in the art and a detailed description is omitted in the interest of brevity. One class of compounds is that used in the automotive airbag art which generates a substantial volume of gas upon detonation. The gas could also be generated by a rapid phase change from a liquid phase contained within the armor cavity where the pressure in the cavity is sufficient to maintain at least a portion of the gas as a liquid until a sudden pressure change caused by the penetration of the armor shell. One, benefit of liquid, phase, or chemical gas generating compounds is the ability to form the armor shell as segments so that an incursion which is defeated by one segment would not leave the armor panel unprotected over its entire width and depth.

The particles contained within the armor shell 10 will be distributed across the interior cavity so as to be readily moved to the site of an incursion by a penetrator. The particles are sufficiently small that when the armor shell is penetrated they will be entrained in the movement of gas flowing rapidly incursion site. The elements can be formed of various substances adapted to create erosion and disruption of the penetrator and disruption of the penetrator path. Examples would be lightweight ceramic particles, ceramic foams, metallic particles, metallic foams, etc.

One embodiment of particulate material would be to fill the hollow cavity 14 of the armor shell 10 with a porous friable medium which has the high pressure gas contained within the porosity of the medium. Such a pre-pressurized material could be inserted into the armor cavity as one or more pieces or layers. On penetration, the friable nature of the material would cause the material to break apart into small irregularly shaped pieces and the gas entrained would be released to move the resulting particulate material towards the point of incursion. Such a structure would inherently provide segmented coverage to the protected panel. It also could be layered so a threat defeated by the first layer or two would not destroy the protective powers of successive protective layers.

Figure 2:
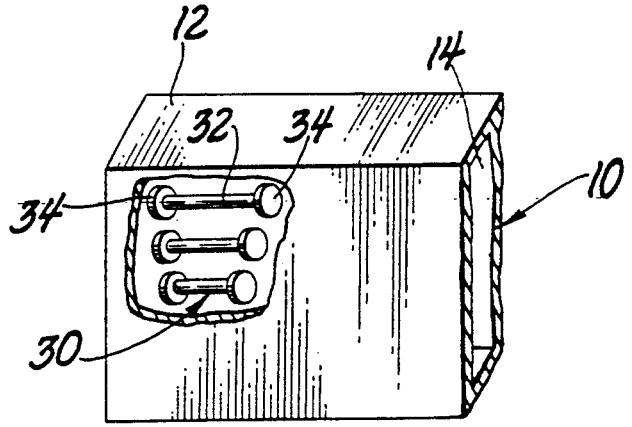
FIG. 2 shows an alternative construction.
Figure 3:
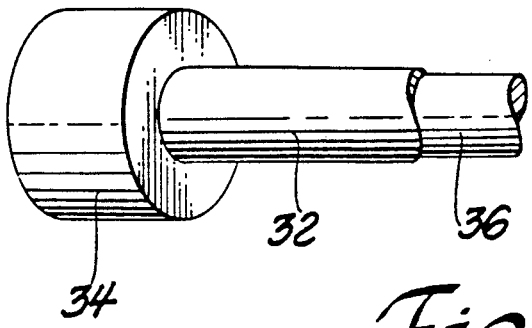
FIG. 3 is an enlarged partial view of the penetrator resisting means of FIG. 2.

A second embodiment of a reactive armor made according to this invention is shown in FIG. 2. In this embodiment the armor shell 10 is also made of a number of armor plates 12 joined to form a cavity 14. The cavity contains a plurality of penetrator resisting means 30 which comprise a center portion 32 having a canister 34 attached to each end. The canisters 34 are filled with a high pressure gas which acts on the ends of rods 36 slideably contained within the center portion 32.

When a penetrator enters the armor shell 10 it will break through one or more of the center portions 32 and the enclosed rods 36. The pressurized gas in canister 34 will form the remaining rod portion away from the canister and against the penetrator thereby disrupting it.

The rods could be formed of ceramic or other material which would act to erode projectiles or disrupt shaped charges as they enter the armor shell 10. The rods could be aligned as a parallel array of rods, multiple arrays or a random type arrangement. Where the rods are aligned in a number of layers in the armor shell 10, the successive layers could be offset so a penetrator which fails to activate the first layer will activate one of the successive layers. Reactive armor of this structure may withstand multiple hits since only a limited amount of the total reactive capability is used with each strike.

I wish it to be understood that I do not desire to be limited to the exact details of construction shown and described, since obvious modification may occur to those skilled in the relevant without departing from the scope and spirit of the following claims.

I claim:

1. A reactive armor structure adapted to resist the incursion of penetrators through the structure comprising: a shaped piece of armor plate material; a source of high pressure compressed gas, a plurality of penetrator resisting means contained within the armor structure said penetrator resisting means being disposed so that they are forced by the pressurized gas into the penetrator at the location of any lowered pressure in the armor structure caused by the intrusion of a penetrator so as to impinge on the penetrator to damage its integrity.

2. The armor structure of claim 1 where the armor structure is formed as a pressure vessel containing a gas under high pressure and containing a multiplicity of particulate elements contained within the cavity, said particulate elements being of a size and shape that they are driven to a site of reduced pressure caused by the incursion of a penetrator by the movement of the pressurized gas. The particulate elements having sufficient force to cause erosion of the penetrators integrity.

3. The armor structure of claim 1 where the penetrator resisting means comprise a plurality of means having a pair of canisters connected by a relatively thinner hollow portion said canister containing a gas under high pressure and a rod disposed within the hollow center portion so that when a penetrator breaks through the hollow center portion the rod is forced into the penetrator by the high pressure gas.

* * * * *